US005419727A

United States Patent [19]

Lemley

[11] Patent Number: 5,419,727

[45] Date of Patent: May 30, 1995

[54] SWIMMER TRAINING AID FOR ENCLOSING A FIST

[76] Inventor: Scott G. Lemley, P.O. Box 2558, Wrightwood, Calif. 92397

[21] Appl. No.: 263,931

[22] Filed: Jun. 21, 1994

Related U.S. Application Data

[63] Continuation of Ser. No. 94,255, Jul. 19, 1993, abandoned.

[51] Int. Cl.[6] ..... A63B 31/00

[52] U.S. Cl. ..... 441/55; 441/58

[58] Field of Search ..... 441/55–58, 441/129, 136, 122; 434/254; 482/111, 55; 128/878, 879, 880, DIG. 20; 2/158, 159, 16, 18

[56] References Cited

U.S. PATENT DOCUMENTS

| | | | |
|---|---|---|---|
| 220,281 | 10/1879 | Glover | 2/18 |
| 1,053,204 | 2/1913 | Morrison | 2/18 |
| 3,122,760 | 3/1964 | Glass, Jr. | 441/57 |
| 3,217,333 | 11/1965 | Sweet et al. | 128/DIG. 20 |
| 3,755,820 | 9/1973 | Petrusek | 128/DIG. 20 |
| 3,802,009 | 4/1974 | Clemente | 441/57 |
| 4,264,994 | 5/1981 | Carbone | 9/309 |
| 4,274,399 | 6/1981 | Mummert | 128/DIG. 20 |
| 4,493,663 | 1/1985 | Richmond | 440/101 |
| 4,832,643 | 5/1989 | Schoofs | 441/56 |
| 5,147,233 | 9/1992 | Hannula | 441/56 |

FOREIGN PATENT DOCUMENTS

| | | | |
|---|---|---|---|
| 397212 | 1/1974 | U.S.S.R. | 2/18 |

OTHER PUBLICATIONS

ASCA Magazine, Apr. 1988, pp. 1 and 15, article by Scott Lemley on p. 15 entitled "First Swimming For Age Groupers."

*Primary Examiner*—Edwin L. Swinehart

*Attorney, Agent, or Firm*—Chernoff, Vilhauer, McClung & Stenzel

[57] ABSTRACT

A reusable fist cover which includes a unitary elastic body having a length about half the length of a hand (including the extended fingers) and defining a recess for receiving and snugly enclosing a hand with curled fingers is disclosed. The body has a wrist end and an attached wrist band defining a wrist opening for receiving a wrist. The body includes a distal portion which is spaced apart from the wrist end by a distance equal to about half the length of a hand and which is located generally opposite the wrist opening for closely contacting the proximal sections of enclosed curled fingers. A portion of the body of the fist cover defines an opening through which a thumb can project and which allows the thumb to remain outside the enclosing recess of the body.

15 Claims, 3 Drawing Sheets

SWIMMER TRAINING AID FOR ENCLOSING A FIST

This is a continuation of application Ser. No. 08/094,255 filed on Jul. 19, 1993, now abandoned.

BACKGROUND OF THE INVENTION

This invention relates to a swimmer training aid for enclosing a swimmer's fist.

Swimming authorities generally agree that the most talented swimmers have an acute sensory perception which enables them to "feel" and effectively handle the water better than the swimmers of average ability. This feel for the water is defined as the swimmer's ability to evaluate the pressure of the water on the palm of the hand. For example, the swimmer needs to evaluate how much pressure there is and from which direction it is coming, as the swimmer pushes and pulls the hands through the water. Evaluating this pressure tells the swimmer how fast the hand should be accelerating or decelerating and how to adjust the pitch of the hand as it travels through the water. The best swimmers have the best feel for the water and make the most efficient evaluations of the water pressure. Consequently, swim coaches use various training aids and techniques to enhance a swimmer's feel for the water, including use of the technique called fist swimming.

When fist swimming, the swimmer reduces the surface area of the hands by clenching the hands into fists in order to develop the feel of pulling not only with the hands, but also with the forearms. To swim efficiently with such a major reduction in effective pulling surface area requires the swimmer to focus his or her undivided attention on the act of swimming.

In addition, when swimming with the hands closed into fists, the swimmer's sensory receptors which are sensitive to pressure and which are located in the palm adapt to the pressure of the fingertips pressing into the palm rather than to the pressure of the water. When this fingertip pressure to the palms is removed by the swimmer unclenching the fists, the swimmer's palms and fingertips are particularly sensitive to the pressure of the moving flow of the water. This resulting heightened awareness of the swimming environment is interpreted as a dramatic feel for the water that has been compared by a swimmer to "having a pair of paddles welded to my wrists."

However, the act of consciously clenching the hand into a fist while swimming causes the swimmer to lose the fluid motion of the stroke and results in the early onset of fatigue of the hand and forearm muscles. Thus, swimmers can swim only short distances with their hands clenched into fists, although the longer the fist swimming drill, the more profound and long lasting the effects of the drill.

Previous methods for keeping the hands closed into fists include taping the clenched hands with duct tape, and placing each hand in a plastic bag and taping the bag in place. Neither of these methods involving tape can be employed quickly or independently by the swimmer. Nor is the tape, or bag and tape, practically reusable, since the tape must be cut or will otherwise effectively be destroyed in order to remove it from the hand.

A previously known fist enclosure is constructed from sewn-together pieces of rip-stop nylon and includes a hole through which the thumb projects. Hook-and-loop fastener material is attached adjacent a wrist opening for fastening the enclosure on the hand. However, such an enclosure is not easy to get off and on the hand, and it is not possible to keep water from pooling in the enclosure. The pooled water tends to distract the swimmer, reducing or destroying the beneficial effect of the device.

None of the known hand enclosures can retain the fingers in a flexed position with fingertips adjacent to the palm without the conscious effort of the swimmer to form a fist, because, if these known enclosures are large enough to fit over the fist, they do not enclose the fingers snugly enough, leaving room for the fingers to open and uncurl. Thus, none of the known hand enclosures provides an easily reusable snug enclosure for a swimmer's fist which maintains the position of the swimmer's fingertips adjacent the palm, thus enabling the swimmer to derive maximum benefits from a fist swimming drill.

What is still needed, then, is a covering for the hand which will press the curled fingertips into the palm when the hand is enclosed and which is also readily installed on and removed from the hand by the swimmer.

SUMMARY OF THE INVENTION

The present invention overcomes the foregoing drawbacks of the prior art by providing a reusable fist cover which includes a unitary elastic body having a length about half the length of a hand (including the extended fingers) and defining a recess for receiving and snugly enclosing a hand with curled fingers. The body has a wrist end and an attached wrist band defining a wrist opening for receiving a wrist. The body includes a distal portion which is spaced-apart from the wrist end by a distance equal to about half the length of a hand and which is located generally opposite the wrist opening for closely contacting the proximal sections of enclosed curled fingers. A portion of the body of the fist cover defines an opening through which a thumb can project and which allows the thumb to remain outside the fist-enclosing recess defined by the body. The swimmer thus retains the use of the thumb for its normal function during the swimming stroke and also for adjusting goggles and the like.

The fist cover of the present invention snugly and elastically encloses the curled fingers of the swimmer's hand, maintaining the fingers in a curled position, and is easily removed from or placed on the hand by the swimmer. The fist cover can remain in place whatever the duration of a fist swimming drill, and can be easily installed at any time during a swim workout to sensitize the swimmer's hand.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENTS

Figure 1:
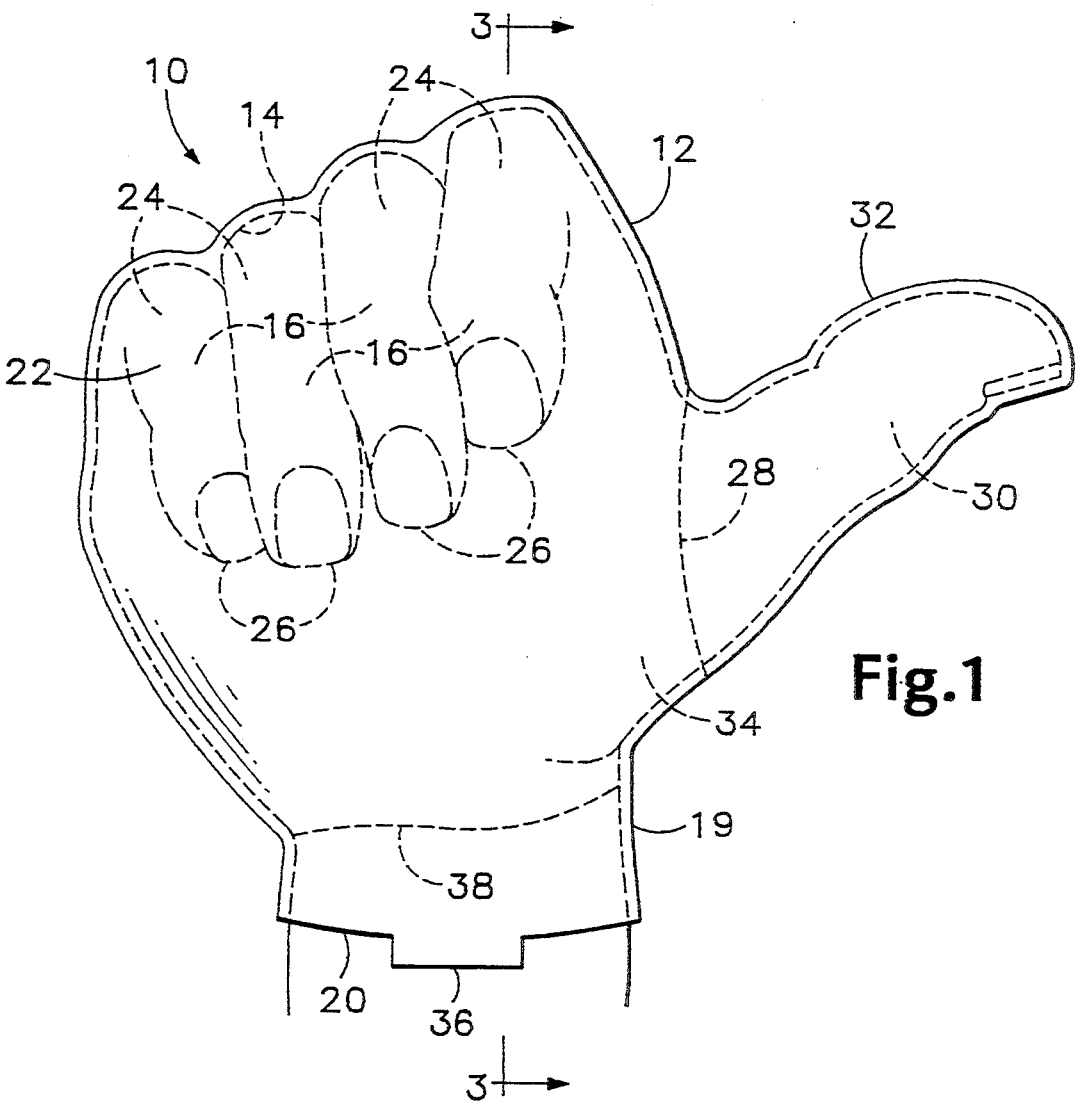
FIG. 1 is a perspective view of a swimmer training aid for enclosing a fist, embodying the present invention.
Figure 2:
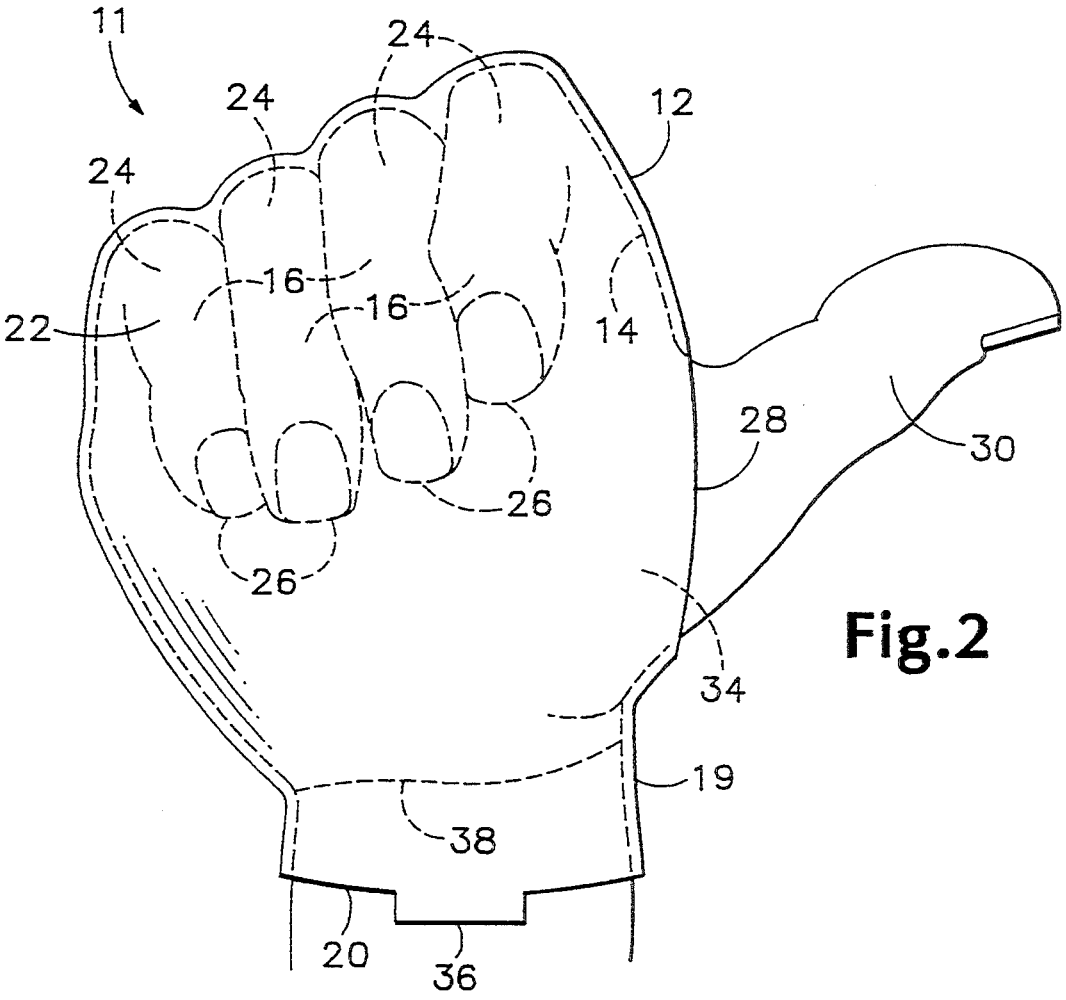
FIG. 2 is a perspective view of an alternative embodiment of the present invention.
Figure 3:
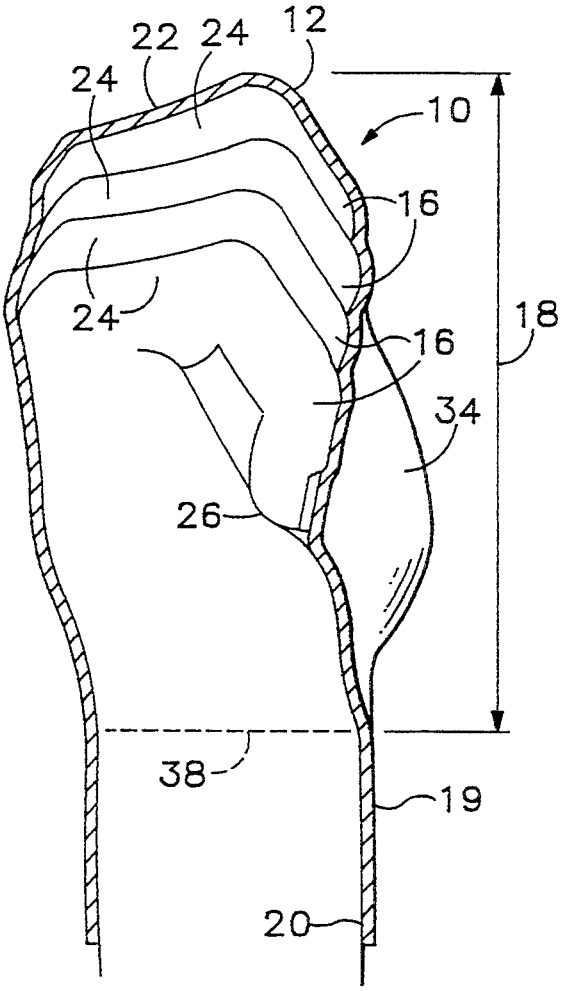
FIG. 3 is a sectional view of the swimmer training aid shown in FIG. 1, taken along line 3—3.

Referring now to the drawings, two alternative embodiments of a swimmer training aid for enclosing a swimmer's fist are shown in FIGS. 1–3. Fist covers 10, 11 each include an elastic body 12. The body 12 defines an interior recess 14 into which a swimmer's hand and curled fingers 16 are inserted. As shown in FIG. 3, the body 12, which has a length 18 which is about half the full length of a swimmer's hand with the fingers of the hand outstretched, has a wrist end 38. A cuff or wrist band 19 defining a wrist opening 20 is attached to the wrist end 38. The body 12 includes a distal portion 22 which is spaced apart from the wrist end 38 by the length 18 of the body. Thus, as shown in FIGS. 1–3, when the interior recess 14 receives a swimmer's hand the fingers 16 must necessarily curl to fit within the recess 14, and the distal portion 22 of the body 12 lies closely against the proximal sections 24 of the fingers, pressing the fingertips 26 into the palm. A tab 36 is attached to the wrist band 19 to be grasped while putting on the fist cover 10 or 11.

The body 12 of the fist cover 10, shown in FIG. 1, includes a thumb opening 28 through which the swimmer's thumb 30 protrudes into a thumb stall 32 connected with and protruding from the body 12 in order to prevent water from entering the interior recess 14. As shown in FIG. 2, in the fist cover 11 the thumb opening 28 is open but snugly and elastically encloses the base 34 of the thumb to prevent the entrance of water into the interior recess 14.

The body 12 of each fist cover 10, 11 is made of an elastic material to snugly surround the swimmer's hand and to maintain the fingers in a curled position. The elastic material is preferably a flexible sheet-like or membranous polymeric material such as a latex or a silicone rubber. The elastic material is preferably a non-absorbent and water-impervious material to inhibit the transfer of water to the interior recess 14. As shown, the elastic body 12 of the fist cover 10 or 11 so closely and snugly encloses the hand that the fingertips 26 are necessarily pressed into the palm and the fingers are prevented from straightening or uncurling.

The fist cover 10 or 11 may be made by any convenient means such as by dipping a suitably-sized form into a fluid polymeric material such as a latex and then curing the material, or by spraying a similar material onto such a form to coat it to the desired thickness, and then curing the material.

Figure 4:
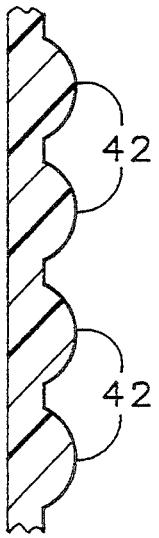
FIG. 4 is an enlarged sectional view of a detail of a swimmer training aid for enclosing a fist, showing a textured surface.

The body of the fist cover 10 or 11 may include a textured surface such as a regular pattern of bumps 42, or other non-smooth texture, as shown in FIG. 4. Such a textured surface may be made by including in the form depressions or indentations which fill with polymeric material when the fist cover is constructed. The fist cover may be worn by the swimmer with the resulting textured surface on the inside or outside.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A fist cover useful as a swimmer training aid for enclosing a swimmer's fist, comprising a body including elastic fist enclosing means made of a flexible material for snugly surrounding a hand with curled fingers and maintaining the fingers in a curled position with the fingertips thereof pressed against the palm thereof, said fist enclosing means being too small to receive said hand with said fingers outstretched, a portion of said body defining a thumb opening through which a thumb of said hand can project, and said body being free of structure surrounding said fist enclosing means.

2. The fist cover of claim 1, said body further including a thumb stall associated with said body at said thumb opening and protruding from said body for receiving and enclosing said thumb therein.

3. The fist cover of claim 1 wherein said body includes a wrist band portion defining a wrist opening for receiving a wrist therethrough and a tab attached to said wrist band portion.

4. The fist cover of claim 1 wherein said fist cover is made of a polymeric material.

5. The fist cover of claim 4 wherein said polymeric material is a latex.

6. The fist cover of claim 4 wherein said polymeric material is a silicone rubber.

7. The fist cover of claim 1 wherein said flexible material is a sheet material.

8. The fist cover of claim 1 wherein said flexible material is a membranous material.

9. A reusable fist cover useful as a swimmer training aid for enclosing a swimmer's fist, comprising a unitary elastic body having a length and a width, said body defining an interior recess having a length and a width for receiving and snugly enclosing a hand with curled fingers therein, said length of said recess being about equal to said width of said recess, and said length of said body being about equal to said width of said body and said length of said recess, wherein said body has a wrist end defining a wrist opening for receiving a wrist therethrough, a distal portion spaced apart from said wrist end by a distance about equal to said length of said recess, said distal portion being located opposite said wrist opening for closely contacting the proximal sections of enclosed curled fingers, and a portion of said body defining a thumb opening for receiving a thumb therethrough.

10. The fist cover of claim 9 further including a thumb stall connected with said body at said thumb opening and protruding from said body for receiving and enclosing a thumb therein.

11. The fist cover of claim 9 including a tab attached to said wrist end.

12. The fist cover of claim 9 wherein said elastic body is made of a non-absorbent material.

13. The fist cover of claim 9 wherein said fist cover is made of a polymeric material.

14. The fist cover of claim 13 wherein said polymeric material is a latex.

15. The fist cover of claim 13 wherein said polymeric material is a silicone rubber.

* * * * *